US005750308A

United States Patent [19]

Tsujita et al.

[11] Patent Number: 5,750,308

[45] Date of Patent: May 12, 1998

[54] ELECTROPHOTOGRAPHIC DEVELOPING METHOD USING DEVELOPING BIAS VOLTAGE BASED ON LIGHT DECAY CHARACTERISTICS OF PHOTOSENSITIVE MATERIAL

[75] Inventors: Mitsuji Tsujita; Nariaki Tanaka; Takashi Terada; Takuji Terada; Ichiro Yamazato; Eiichi Miyamoto, all of Chuo-ku, Japan

[73] Assignee: Mita Industrial Co., Ltd., Osaka, Japan

[21] Appl. No.: 754,624

[22] Filed: Nov. 21, 1996

Related U.S. Application Data

[63] Continuation-in-part of Ser. No. 544,985, Oct. 30, 1995, abandoned.

[30] Foreign Application Priority Data

Oct. 31, 1997 [JP] Japan ..... 6-267792

[51] Int. Cl.$^6$ ..... G03G 13/06

[52] U.S. Cl. ..... 430/120; 399/48

[58] Field of Search ..... 430/120, 124; 399/48, 49

[56] References Cited

U.S. PATENT DOCUMENTS

| | | | |
|---|---|---|---|
| 4,755,850 | 7/1988 | Suzuki et al. | 430/120 |
| 4,814,834 | 3/1989 | Endo et al. | 430/120 |
| 5,266,997 | 11/1993 | Nakane et al. | 399/49 |
| 5,604,074 | 2/1997 | Yasuda et al. | 430/120 |

*Primary Examiner*—John L. Goodrow
*Attorney, Agent, or Firm*—Sherman and Shalloway

[57] ABSTRACT

An electrophotographic method in which an electrostatic latent image on a single-layer organic photosensitive material is developed while applying a developing bias voltage of the same polarity as the polarity of the charge of the photosensitive material. The developing bias voltage is set to be higher than a potential that corresponds to a point where a curve approximating the zone of a large amount of exposure to light and a curve approximating the zone of a small amount of exposure to light in a light decay characteristics curve intersect each other.

8 Claims, 4 Drawing Sheets

ELECTROPHOTOGRAPHIC DEVELOPING METHOD USING DEVELOPING BIAS VOLTAGE BASED ON LIGHT DECAY CHARACTERISTICS OF PHOTOSENSITIVE MATERIAL

CROSS-REFERENCE TO RELATED APPLICATIONS

This application is a continuation-in-part of application Ser. No. 08/544,985, filed Oct. 30, 1995 now abandoned.

BACKGROUND OF THE INVENTION

1. Field of the Invention

The present invention relates to an electrophotographic method by using a single-layer organic photosensitive material and utilizing high-sensitivity characteristics with a small amount of exposure to light. More specifically, the invention relates to an electrophotographic method by which a single-layer oaganic photosensitive material in which the decay of electric charge becomes slow at around a half amount of exposure to light is adapted to a high-speed electrophotographic system without generating fogging.

2. Description of the Prior Art

In an electrophotographic method, a photosensitive material for electrophotography is electrically charged, exposed to image-bearing light to form electrostatic latent image, which is then developed with toner in a state where a developing bias voltage is applied thereto, and the toner image that is formed is transferred to a transfer paper followed by fixing to form an image.

As a photosensitive material used for the electrophotographic method, there have heretofore been used a selenium photosensitive material and an amorphous silicon photosensitive material. In recent years, however, organic photosensitive materials (OPC) have been extensively used. Representative examples of the organic photosensitive materials include a laminated photosensitive material of the function-separated type in which a charge-generating material (CGM) and a charge-transporting material (CTM) are laminated as separate layers, and a single-layer photosensitive material in which CGM and CTM are provided as a single dispersion layer.

Among these organic photosensitive materials, the single-layer photosensitive material has a charge-generating material that is dispersed in a resin medium in which a charge-transporting material is dissolved. In some laminated-layer photosensitive materials, furthermore, the layer of charge-generating material has the charge-generating material dispersed in the resin medium.

When a photosensitive material is exposed to image-bearing light as shown in FIG. 1 which illustrates a relationship between the surface potential and the time, the potential in a dark portion (D) decays only slightly in response to dark decay property whereas the potential in a bright portion (L) decays quickly in response to light decay property, whereby a potential contrast adapted to developing is formed.

The sensitivity of the photosensitive material corresponds to the rate of light decay and is, generally, evaluated in terms of the amount of exposure to light needed for halving the potential relative to the initial potential of before being exposed to light, i.e., evaluated in terms of a half amount of exposure to light (lux×sec).

When the photosensitive material is exposed to light, the electric charge quickly decays up to nearly the half amount of exposure to light. As the amount of exposure exceeds the half amount of exposure to light, however, the electric charge decays slowly.

To prevent the fogging due to residual potential in a bright portion, on the other hand, the amount of exposure to light must be set to a considerably large value compared with the half amount of exposure to light.

For this purpose, a source of light having a large output is necessary and a large cooling fan is needed to remove the heat generated by the source of light, resulting in an increase in the cost of the apparatus and the cost of electric power. Moreover, exposing an organic photosensitive material to a large quantity of light causes the photosensitive material to be deteriorated. On the other hand, when the source of light having a small output is used, an extended period of time is required for the step of exposure to light imposing limitation on the speed of copying and on the printing speed in the facsimile or laser printer.

SUMMARY OF THE INVENTION

The object of the present invention, therefore, is to provide an electrophotographic method which is capable of forming vivid image without fogging and, particularly, capable of forming image with a small amount of exposure to light by utilizing high-sensitivity characteristics of a single-layer organic photosensitive material in the zone of a small amount of exposure to light.

Another object of the present invention is to provide an electrophotographic method of a type which is realized using a cheaply constructed device and consumes small amounts of resources and small amounts of energy by using a single-layer organic photosensitive material.

According to the present invention, there is provided an electrophotographic method comprising electrically charging a single-layer organic photosensitive material, exposing the photosensitive material to image-bearing light to form electrostatic latent image, and developing the electrostatic latent image in a state where a developing bias voltage is applied, wherein said developing bias voltage is set to a potential which has a polarity same as the polarity of the electric charge in the photosensitive material, and is higher than a potential (hereinafter often called as point-of-intersection voltage ($E_H$)) that corresponds to a point where a straight line approximating to a light decay characteristics curve in the zone of a large amount of exposure to light and a straight line approximating to a light decay characteristics curve in the zone of a small amount of exposure to light intersect each other.

The present invention can be advantageously adapted to a single-layer organic photosensitive material in which the decay of electric charge becomes slow at around a half amount of exposure to light, to a single-layer organic photosensitive material of the type in which a charge-generating material is dispersed and, preferably, and in a single-dispersion-layer photosensitive material a charge-generating substance is dispersed in a resin medium that includes a charge-transporting substance. It is most desirable to use a single-dispersion-layer photosensitive material of the positively charged type.

The photosensitive material used in the present invention exhibits its effects most conspicuously when it has light decay characteristics represented by the following formula (1), $$V=Vo\{A\cdot\exp(-B\cdot I)+C\cdot\exp(-D\cdot I)\} \quad (1)$$

where I is an amount of exposure to light (lux·sec), V is an absolute value (volts) of potential on the surface of the photosensitve material when the amount of exposure to light is I, Vo is an absolute value (volts) of initial potential on the surface of the photosensitive material, A is numeral of from 0.7 to 1(exclusive)and C is numeral of from 0(exclusive) to 0.3, with the proviso that their sum (A+C)is 1, B is a coefficient of from 0.1 to 1.5 $lux^{-1}\cdot sec^{-1}$, and D is a coefficient of from 0.01 to 0.2 $lux^{-1}\cdot sec^{-1}$.

It is desired that the developing bias voltage (EB) for the above-mentioned photosensitive material is set to a voltage (volts) that satisfies the following formula (2), $$EB=m[Y\times 10^{Z}]$$

wherein

Y is an antilogarithm of a martissa of formula of $$\frac{P\times L-K\times Q}{P-K} \tag{2a}$$

Z is an index of formula of $$\frac{P\times L-K\times Q}{P-K} \tag{2a}$$

$$K=\frac{\log VL_{0.9}-\log VL_{0.7}}{IL_{0.9}-IL_{0.7}} \tag{3}$$

$$P=\frac{\log VS_{0.9}-\log VS_{0.8}}{IS_{0.9}-IS_{0.8}} \tag{4}$$

$$L=\frac{\log VL_{0.9}IL_{0.7}-\log VL_{0.7}IL_{0.9}}{IL_{0.7}-IL_{0.9}} \tag{5}$$

$$Q=\frac{\log VS_{0.9}IS_{0.8}-\log VS_{0.8}IS_{0.9}}{IS_{0.8}-IS_{0.9}} \tag{6}$$

where $VL_{0.9}$ is 0.9 VoA, $IL_{0.9}$ is the amount of exposure to light corresponding to $VL_{0.9}$ of the formula (1), $VL_{0.7}$ is 0.7VoA, $IL_{0.9}$ is the amount of exposure to light corresponding to $VL_{0.7}$ of the formula (1), $VS_{0.9}$ is 0.9 VoC, $IS_{0.9}$ is the amount of exposure to light corresponding to $VS_{0.9}$ of the formula (1), $VS_{0.8}$ is 0.8 VoC, $IS_{0.8}$ is the amount of exposure to light corresponding to $VS_{0.8}$ in the formula (1), and m is a number not smaller than 1.5 and, preferably, from 1.5 to 4.0.

In the present invention, furthermore, it is desired that the amount of exposure to light in a bright portion is so set that the absolute value of a residual potential (ER) in the bright portion is smaller than the absolute value of the bias potential (EB) during the exposure to image-bearing light. How low the residual potential be set is determined as described below. That is, the amount of exposure to light in a bright portion is so set that the residual potential (ER) in the bright portion satisfies the formula (7), $$ER=EB-nED0 \tag{7}$$

where EB is a developing bias potential, ED0 is a potential at which the fogging density becomes substantially zero in relation to developing sensitivity characteristics of a combination of the photosensitive material and the developer, and n is a number of from 0.4 to 2.5 and, most preferably, from 0.5 to 1.0, though it may vary depending upon a light decay curve of potential of the photosensitive material, applied bias potential, and developing sensitivity characteristics of the photosensitive material and of the developer.

DETAILED DESCRIPTION OF THE INVENTION

Figure 1:
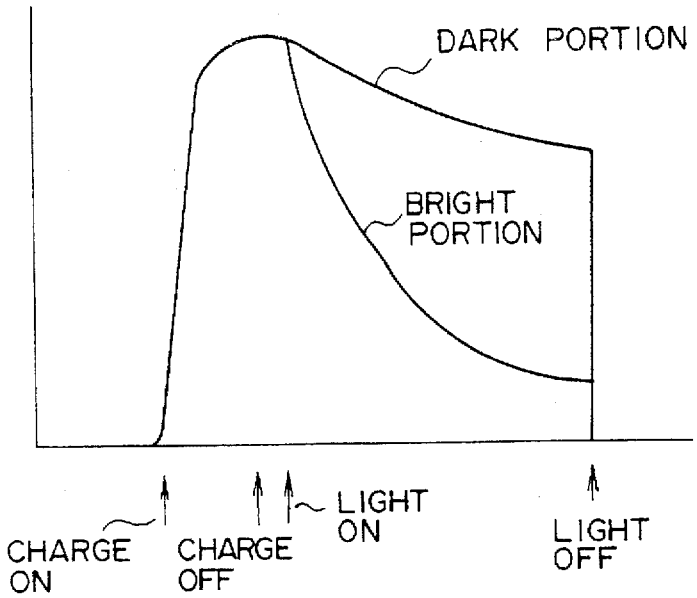
FIG. 1 is a diagram explaining the change of the surface potential when a photosensitive material is being exposed to image-bearing light.
Figure 2:
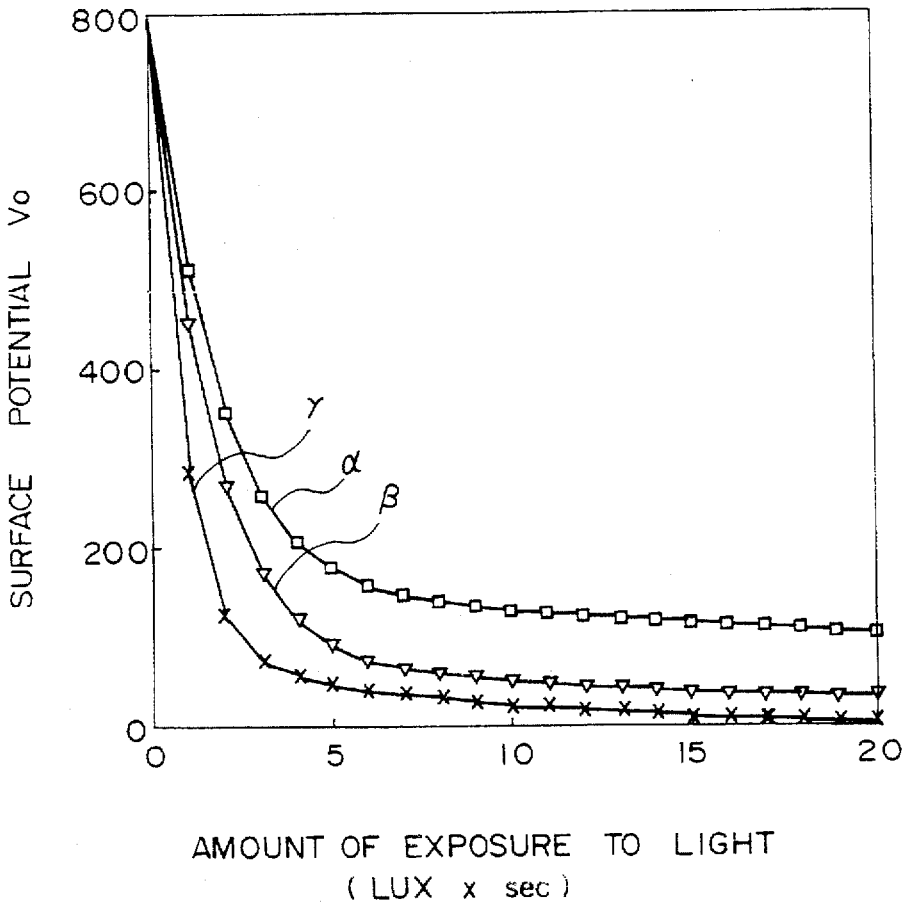
FIG. 2 is a graph illustrating a relationship (light decay characteristics) between the amount of exposure to light and the surface potential concerning photosensitive materials α (example), β (comparative example), and γ (comparative example)

Referring to FIG. 2 illustrating a relationship between the amount of exposure to light and the potential on the surface of a photosensitive material, a curve α represents characteristics of a single-layer organic photosensitive material, a curve β represents characteristics of a laminated-layer organic photosensitive material and a curve γ represents characteristics of an amorphous silicon photosensitive material (their details will be described later in Examples). In all of these curves, the potentials rapidly break in the initial stage due to light decay characteristics in the zone of a small amount of exposure to light but change mildly in the zone of a large amount of exposure to light so as to approach predetermined saturation values.

Figure 3:
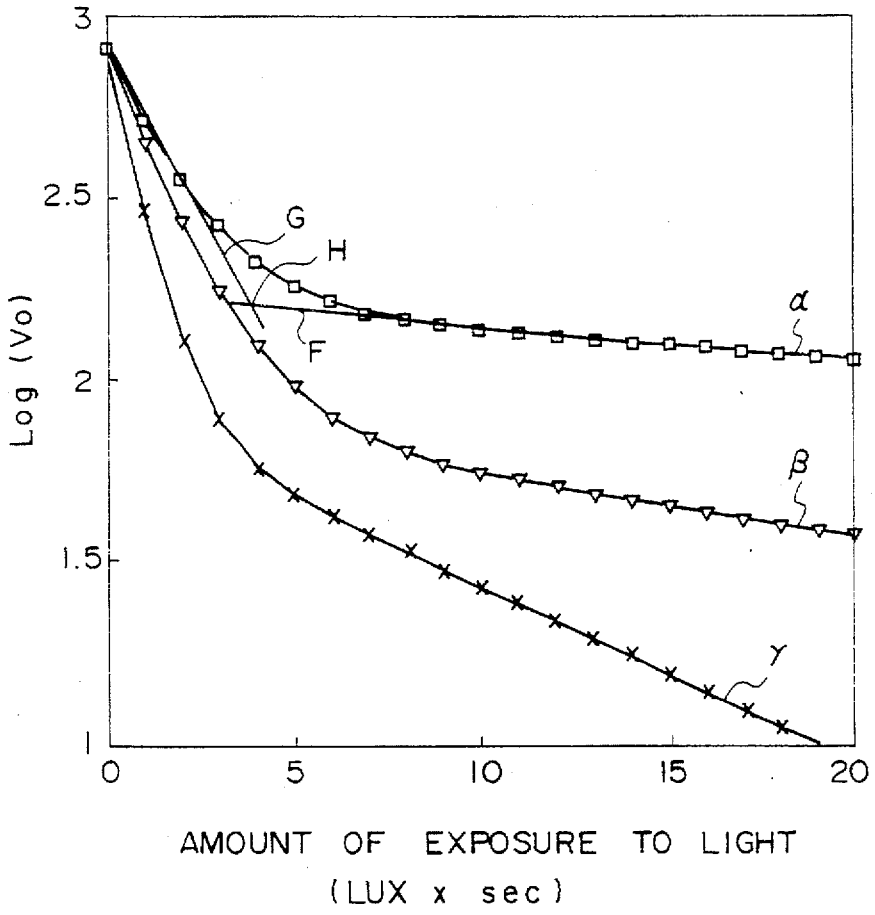
FIG. 3 is a diagram illustrating a method of finding a point of intersection between a straight line approximating to a light decay characteristics curve in the zone of a large amount of exposure to light and a straight line approximating to a light decay characteristics curve in the zone of a small amount of exposure to light from the plots of logarithmic values of the surface potential and the amount of exposure to light.

According to the present invention, the developing bias potential (EB) is set to be higher than a potential that corresponds to a point of intersection H where a line F approximating to the light decay characteristics curve α in the zone of a large amount of exposure to light intersects a line G approximating to the light decay characteristics curve α in the zone of a small amount of exposure to light in FIG. 3 where the light decay characteristics curve of FIG. 2 are plotted on a logarithmic scale (though the point of intersection H is shown concerning the curve α only to simplify the drawing, it should be noted that the same also holds true even for other curves).

The line F approximating to the curve α in the zone of a large amount of exposure to light represents low sensitivity characteristics in the zone of a large amount of exposure to light of the photosensitive material and the line G approximating to the curve α in the zone of a small amount of exposure to light represents high sensitivity characteristics in the zone of a small amount of exposure to light of the photosensitive material. In the present invention, therefore, the developing bias potential (EB) is set to be higher than a potential that corresponds to the point of intersection H of these two lines in order to effectively utilize high sensitivity characteristics in the zone of a small amount of exposure to light thereby to form an electrostatic latent image of a high contrast with a small amount of exposure to light or within a short exposure time.

The light decay in the photosensitive material varies as an exponential function and can be approximated by the above-mentioned formula (1) which is the sum of two exponential functions. That is, the absolute value (volts) of potential on the surface of the photosensitive material with the amount I of exposure to light (lux·sec) is measured relative to the absolute value Vo (volts) of the initial potential on the surface of the photosensitive material, and the measured values are substituted for the formula (1) to find values of coefficients A, B, C and D. Here, however, A and C are such that their sum is 1.

Light decay characteristics (light sensitivity characteristics) of potential of the photosensitive material can be represented by values of four coefficients A, B, C and D. It can be said that the photosensitive material having a large coefficient A is highly sensitive and that the photosensitive material having a large coefficient C loses the electric charge at a small rate when it is exposed to large amounts of light.

In the photosensitive material used in the present invention, it is desired that the coefficients A and C are numbers of from 0.7 to 1 (exclusive) and from 0 (exclusive) to 0.3, respectively, under the condition that their sum is 1, that the coefficient B is from 0.1 to 1.5 lux·sec$^{-1}$ and that the coefficient D is from 0.01 to 0.2 lux·sec$^{-1}$. Among these coefficients, A and C affect seriously. In a single-layer organic photosensitive material, the coefficient A has a value of from 0.75 to 0.85 and in a laminated-layer organic photosensitive material, the coefficient A has a value of from 0.9 to 0.80. In an amorphous silicon photosensitive material, the coefficient A has a value of from 0.95 to 0.85. However , in a single-layer organic photosensitive material the point-of-intersection voltage (EH) is meaningful for setting the developing bias voltage , in a laminated-layer organic photosensitive material or an amorphous silicon photosensitive material the point-of-intersection voltage (EH) is meaningless for such setting.

The present invention can be applied particularly advantageously to a single-layer organic photosensitive material which loses the electric charge mildly at around a half amount of exposure to light, i.e., to a single-layer organic photosensitive material in which the charge-generating material is dispersed and, particularly, to a single-dispersion-layer photosensitive material in which the charge-generating substance is dispersed in a resin medium which contains a charge-transporting substance and, most desirably, to a single-dispersion-layer photosensitive material of the positively charged type.

The suitable developing bias potential (EB) can be found by a graphic solution from a light decay characteristics curve of the photosensitive material shown in FIG. 2 or can be found from a point of intersection H of a line F approximating to the curve α in the zone of a large amount of exposure to light and a line G approximating to the curve α in the zone of a small amount of exposure to light based upon the plotting of logarithmic values of the surface potential and the amount of exposure to light shown in FIG. 3. However, the method of FIG. 3 makes it possible to find the suitable developing bias potential (EB) more correctly. Moreover , if the coefficients A,B,C and D are determined by least square method based on the measured values of the surface potential corresponding to the varied amount of the light exposure, K,P,L and Q in equations (3),(4),(5) and (6) are directly calculated and then EB is obtained from equation(2).

In general, the developing bias potential (EB) is given by the above-mentioned formula (2), wherein K gives a gradient of the line F approximating to the curve in the zone of a small amount of exposure to light and P gives a gradient of the line G approximating to the curve in the zone of a large amount of exposure to light.

On the side of the zone of a small amount of exposure to light, there are employed a surface potential of 0.9 VoA, the amount of exposure to light corresponding thereto, a surface potential of 0.7 VoA and the amount of exposure to light corresponding thereto. This is because they give a good straight line F approximating to the curve in the zone of a small amount of exposure to light. On the side of the zone of a large amount of exposure to light, similarly, there are employed a surface potential of 0.9 VoC, the amount of exposure to light corresponding thereto, a surface potential of 0.8 VoC and the amount of exposure to light corresponding thereto. This is because they give a good straight line G approximating to the curve the zone of a large amount of exposure to light.

In the above-mentioned formula (2), m is a number which is not smaller than 1.5 and, preferably, which lies over a range of from 1.5 to 4.0. When m is smaller than the above range, the fogging density increases, which is not desirable as demonstrated in Example appearing later. When m is too great, on the other hand, there result carrier trail and drop in the image density, which are not desirable, either.

According to the present invention, furthermore, the amount of exposure to light in a bright portion is so set that the residual potential (ER) at the bright portion is lower than the bias potential (EB). As pointed out already, setting the developing bias potential (EB) to a large value means that the residual potential (ER) at the bright portion can be set to a large value during the exposure to light which, then, means that the amount of exposure to light or the exposure time can be decreased.

In practice, referring to Examples appearing later, when the developing bias potential is set to lie within a range contemplated by the invention, there is obtained an image of a high density with a decreased amount of exposure to light suppressing the fogging density compared with when the developing bias potential is set to a value outside the range of the present invention, which is quite an unexpected fact.

Therefore, the present invention requires a source of light of a small output and a cooling fan of a small size for removing the heat from the source of light, making it possible to decrease the cost of the apparatus and the power cost. Moreover, since the organic photosensitive material needs be illuminated with a small amount of light, the photosensitive material is less deteriorated with light, which is an advantage. When a customary source of light is used, furthermore, the step of exposure to light is accomplished within short periods of time, making it possible to greatly increase the copying speed, printing speed of a facsimile and printing speed of a laser printer.

How low the residual potential be set is so determined as described below. That is, the amount of exposure to light at the bright portion is so determined that the residual potential (ER) at the bright portion satisfies the above-mentioned formula (7) though it may vary depending upon a light decay characteristics curve of potential of the photosensitive material, applied bias potential, and developing sensitivity characteristics of the photosensitive material and the developing material.

Figure 4:
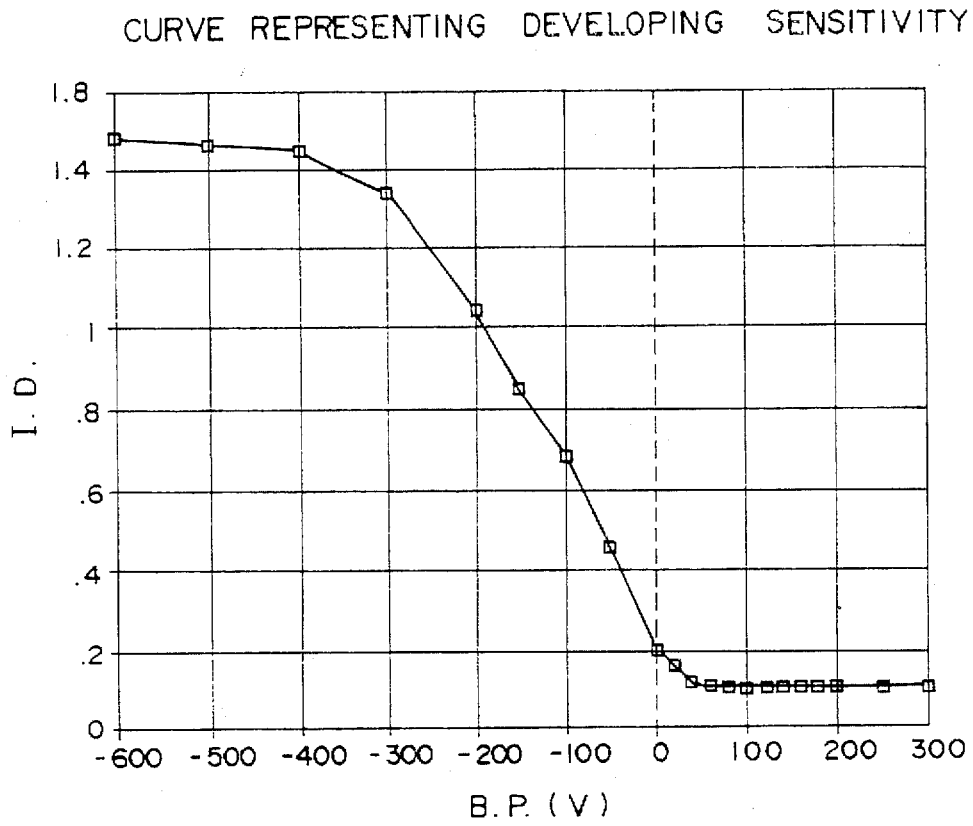
FIG. 4 is a graph plotting a relationship (developing sensitivity characteristics) between the voltage applied to the developing sleeve and the optical density (I.D.) of the toner layer transferred (developed) onto the non-charged photosensitive layer concerning a combination of the negatively charged toner and the non-charged photosensitive layer.

In general, when the substrate of the photosensitive material is grounded and a voltage (bias voltage) of a polarity same as the polarity of the charge of the toner is applied to the developing sleeve which supports the toner without charging the photosensitive layer, the optical density of the transferred toner on the photosensitive layer increases with an increase in the applied voltage. Even when the voltage is brought to zero, however, transfer of the toner takes place, and the toner concentration on the photosensitive layer does not become zero. In FIG. 4 are plotted a relationship (developing sensitivity characteristics) between the voltage applied to the developing sleeve and the optical density (I.D.) of the toner layer transferred (developed) onto the non-charged photosensitive layer for a combination of the negatively charged toner and the non-charged photosensitive layer. According to the diagramed results, the toner is developed even when no voltage is applied. To prevent the toner from being developed, it will be understood that a voltage (generally, a voltage of the same polarity as the photosensitive material) of a polarity opposite to the polarity of charge of the toner must be applied to the developing sleeve.

If a potential at which the fogging density becomes substantially zero is denoted as ED0 concerning developing sensitivity characteristics of a combination of a particular photosensitive material and a particular developer, it is theoretically required that a difference between the bias potential EB and the residual potential ER of the exposed bright portion must be greater than ED0. Under practical developing conditions, however, fogging in the white portion can be eliminated if the difference is not smaller than 0.4 times of ED0.

Referring to the above-mentioned formula (7), when n is smaller than 0.4, fogging in the white portion increases, which is not desirable. When n is greater than 2.5, on the other hand, no particularly distinguished merit is obtained in regard to preventing fogging but resulting in an increase in the amount of exposure to light, which is not desirable, either.

[Outline of Electrophotographic Method]

Figure 5:
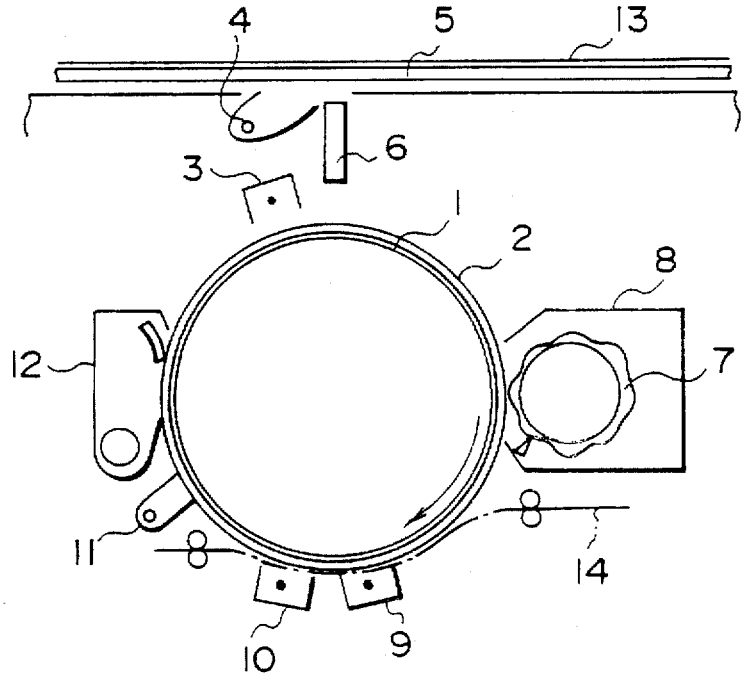
FIG. 5 is a diagram illustrating the arrangement of a device (copying machine) used for the electrophotographic method of the present invention.

Referring to FIG. 5 illustrating an apparatus (copying machine) used for the electrophotographic method of the present invention, a single-layer organic photosensitive layer and, particularly, a single-layer organic photosensitive layer 2 is provided on the surface of a metal drum 1 that is rotated.

Along the periphery of the drum are provided a corona charger 3 for main charging, a lamp 4, a mechanism for exposure to image-bearing light comprising a document-support transparent plate 5 and an optical system 6, a developing mechanism 8 having a developer 7, a corona charger 9 for transferring the toner from the photosensitive layer to a paper, a corona charger 10 for separating the paper, a lamp 11 for removing electric charge, and a cleaning mechanism 12 in the order mentioned.

Briefly described below are the steps for forming image by the electrophotographic apparatus.

First, the photosensitive layer 2 is electrically charged by the corona charger 3 to a predetermined polarity. Next, the document 13 to be copied is illuminated with the lamp 4, so that the photosensitive layer 2 is exposed to light image of the document via the optical system 6 thereby to form an electrostatic latent image corresponding to the document image. The electrostatic latent image is visualized through the developing mechanism 8 to form a toner image. A transfer paper 14 is so fed as to come into contact with the surface of the drum at a position of the charger 9 for transferring the toner, and the back surface of the transfer paper 14 is subjected to the corona charging of a polarity same as that of the electrostatic image to transfer the toner image onto the transfer paper 14. The transfer paper 14 onto which the toner image is transferred is electrostatically peeled off the drum as the electric charge is removed by the corona charger 10 for separation and is sent to a processing zone such as fixing zone (not shown). Residual charge is removed from the photosensitive layer 2 after the toner has been transferred as it is exposed over its whole surface to the light from the lamp 11 for removing electric charge and, then, the residual toner is removed by the cleaning mechanism 12.

Figure 6:
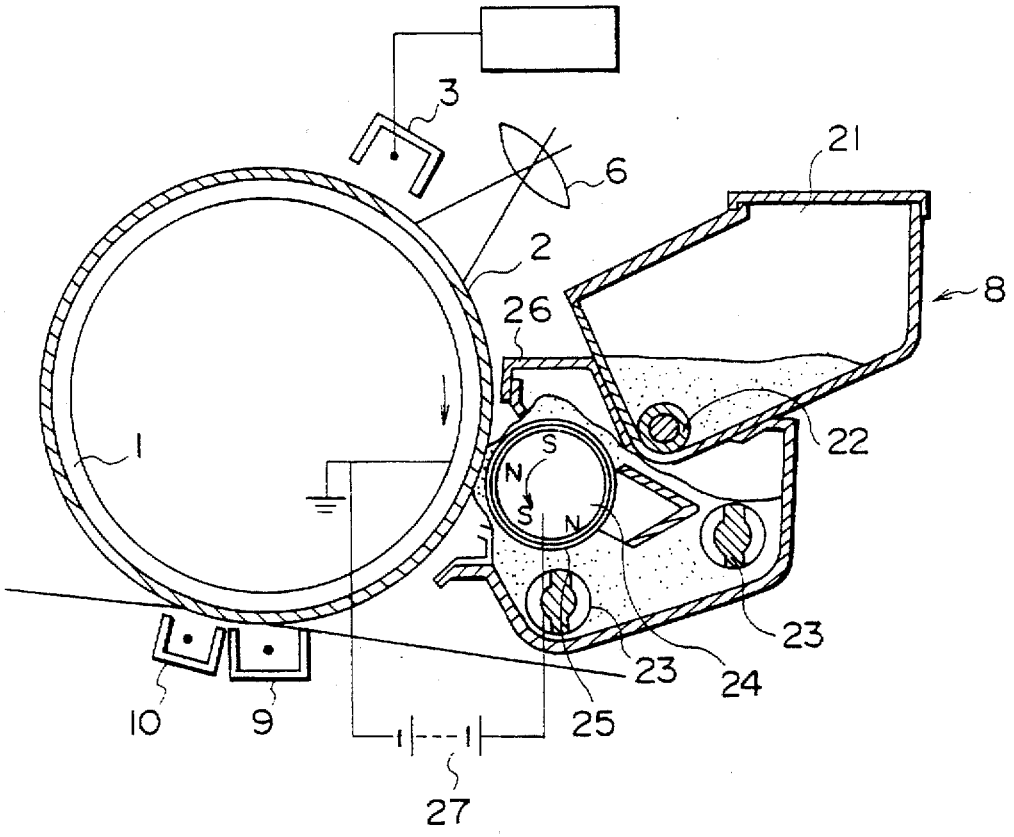
FIG. 6 is a diagram of arrangement illustrating a developing device on an enlarged scale.

The developing device 8 which is shown on an enlarged scale in FIG. 6 includes a toner feed hopper 21, a toner feed roller 22, a developer stirrer roller 23, and a cylindrical developer conveyer sleeve 25 containing a magnet 24 in which N-pole and S-pole are alternatingly arranged. On the side of feeding the developer, there is provided a blade 26 for trimming the ear of the magnetic brush on the sleeve to a predetermined length.

In the developing device, at least either the magnet 24 or the sleeve 25 is allowed to rotate, and the direction of conveying the magnetic brush may be either the same as or opposite to the drum 1 at a position where it is in contact therewith.

The sleeve 25 is made of a nonmagnetic electrically conducting material such as aluminum, and a bias power source 27 is connected to the sleeve 25 so that a predetermined developing bias potential is applied to the developing sleeve 25, the developing bias potential having a polarity same as the polarity of the electric charge on the surface of the photosensitive material.

In the device shown in FIG. 4, the exposure to image-bearing light is effected by a mechanism for exposure to image-bearing light constituted by the lamp 4, document-support transparent plate 5 and optical system 6. However, the exposure to image-bearing light can also be effected using an exposure device based upon a widely known laser beam or an array of light-emitting diodes (LEDs).

According to the present invention, developing is effected by setting the developing bias potential (EB) applied across the sleeve 25 and the photosensitive drum 1 to be greater than a potential that corresponds to a point of intersection H (FIG. 3) of a line approximating to the light decay curve of the photosensitive layer 2 in the zone of a large amount of exposure to light and the line approximating to said curve in the zone of a small amount of exposure to light. The bias voltage (EB) is desirably such that the value m in the above-mentioned formula (2) is not smaller than 1.5 and, particularly, lies over a range of from 1.5 to 4.0.

The amount of exposure to light at the bright portion is so set that the residual potential (ER) at the bright portion becomes smaller than the bias potential (EB) and, more preferably, that the value n in the formula (7) is from 0.4 to 2.5 and, particularly, from 0.5 to 2.0.

[Photosensitive Material]

The photosensitive material used in the present invention is a single-layer organic photosensitive material provided it satisfies the above-mentioned formula (1).

Great effects are exhibited by a single-layer organic photosensitive material and, particularly, by a single-layer organic photosensitive material in which a charge-generating material is dispersed in a resin medium and, particularly, distinguished effects are exhibited by a single-dispersion-layer photosensitive material which contains a charge-transporting material and, particularly, a positive hole-transporting material and a charge-generating material in a resin medium.

Examples of the charge-generating material include selenium, selenium-tellurium, amorphous silicon, pyrylium salt, azo pigment, dis-azo pigment, tris-azo pigment, anthanthrone pigment, phthalocyanine pigment, indigo pigment, threne pigment, toluidine pigment, pyrazoline pigment, pyranthrone pigment, perylene pigment and quinacridone pigment, which may be used in a single kind or in a mixture of two or more kinds to exhibit an absorption wavelength over a desired region.

Among them, phthalocyanine pigment, perylene pigment and dis-azo pigment are preferred.

A variety of resins can be used as resin media for dispersing the charge-generating material. Examples include olefin polymers such as styrene polymer, acrylic polymer, styrene-acrylic polymer, ethylenevinyl acetate copolymer, polypropylene, ionomer, etc. and polyvinyl chloride, vinyl chloride-vinyl acetate copolymer, polyester, alkyd resin, polyamide, polyurethane, epoxy resin, polycarbonate, polyarylate, polysulfone, dialylphthalate resin, silicone resin, ketone resin, polyvinyl butyral resin, polyether resin and phenolic resin, and photocurable resins such as epoxy-acrylate. These binder resins may be used in a single kind or in a mixture of two or more kinds. Preferred resins are styrene polymer, acrylic polymer, styrene-acrylic polymer, polyester, alkyd resin, polycarbonate, polyarylate, etc.

A particularly preferred resin is a polycarbonate derived from a phosgene and bisphenols represented by the following general formula (8),

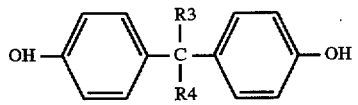

(8)

wherein R3 and R4 are hydrogen atoms or lower alkyl groups, and R3 and R4, being coupled together, may form a cyclic ring such as a cyclohexane ring together with carbon atoms bonded thereto.

The charge transporting material (CTM) may have electron-transporting property or positive hole-transporting property. Or, they may be used in combination. Suitable examples include electron attractive substances such as paradiphenoquinone derivatives, benzoquinone derivatives, naphthoquinone derivatives, tetracyanoethylene, tetracyanoquinodimethane, chloroanil, bromoanil, 2,4,7-trinitro-9-fluorenone, 2,4,5,7-tetranitro-9-fluorenone, 2,4,7-trinitro-9-dicyanomethylene fluorenone, 2,4,5,7-tetranitroxanthone, and 2,4,8-trinitrothioxanthone, as well as high molecules derived from those electron attractive substances.

Among them, paradiphenoquinone derivatives and, particularly, asymmetrical paradiphenoquinone derivatives are excellent in solubility and in electron-transporting property.

Paradiphenoquinone derivatives represented by the following general formula (9) are used,

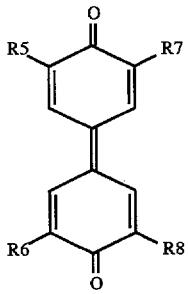

(9)

wherein R5, R6, R7 and R8 are hydrogen atoms, alkyl groups, cycloalkyl groups, aryl groups, aralkyl groups or alkoxy groups.

It is desired that the substituents R5, R6, R7 and R8 exist in asymmetrical forms. Among the substituents R5, R6, R7 and R8, it is desired that two of them are lower alkyl groups, and other two are branched chain alkyl groups, cycloalkyl groups, aryl groups or aralkyl groups.

Though there is no particular limitation, suitable examples include 3,5-dimethyl-3',5'-di-t-butyldiphenoquinone, 3,5-dimethoxy-3',5'-di-t-butyldiphenoquinone, 3,3'-dimethyl-5,5'-di-t-butyldiphenoquinone, 3,5'-dimethyl-3',5-di-t-butyldiphenoquinone, 3,5,3',5'-tetramethyldiphenoquinone, 2,6,2',6'-tetra-t-butyldiphenoquinone, 3,5,3',5'-tetraphenyldiphenoquinone, 3,5,3',5'-tetracyclohexyldiphenoquinone and the like. These diphenoquinone derivatives have low molecular symmetry, exhibit small mutual action among the molecules and are excellent in solubility.

As the positive hole-transporting substances, the following substances have been known. Among them, those compounds having excellent solubility and positive hole-transporting property are used:

pyrene;
N-ethylcarbazole;
N-isopropylcarbazole;
N-methyl-N-phenylhydrazino-3-methylidene-9-carbazole;
N,N-diphenylhydrazino-3-methylidene-9-ethylcarbazole;
N,N-diphenylhydrazino-3-methylidene-10-ethylphenothiazine;
N,N-diphenylhydrazino-3-methylidene-10-ethylphenoxazine;
p-diethylaminobenzaldehyde-N,N-diphenylhydrazone;
p-diethylaminobenzaldehyde-α-Naphthyl-N-phenylhydrazone;
p-pyrolidinobenzaldehyde-N,N-diphenylhydrazone;
1,3,3-trimethylindolenine-ω-aldehyde-N,N-diphenylhydrazone;
p-diethylbenzaldehyde-3-methylbenzthiazolinone-2-hydrazone; and salts of those hydrazone;
2,5-bis(p-diethylaminophenyl)-1,3,4-oxadiazole;
1-phenyl-3-(p-diethylaminostyryl)-5-(pdiethylaminophenyl)pyrazoline;
1-[quinonyl(2)]-3-(p-diethylaminostyryl)-5-(pdiethylaminophenyl)pyrazoline;
1-[pyridyl(2)]-3-(p-diethylaminostyryl)-5-(pdiethylaminophenyl)pyrazoline;
1-[6-methoxy-pyridyl(2)]-3-(diethylaminostyryl)-5-(p-diethylaminophenyl)pyrazoline;
1-[pyridyl(3)]-3-(p-diethylaminostyryl)-5-(diethylaminophenyl)pyrazoline;
1-[lepidyl(3)]-3-(p-diethylaminostyryl)-5-(p-diethylaminophenyl)pyrazoline;
1-[pyridyl(2)]-3-(p-diethylaminostyryl)-4-methyl-5-(p-diethylaminophenyl)pyrazoline;
1-[pyridyl(2)]-3-(α-Methyl-p-diethylaminostyryl)-3-(p-diethylaminophenyl)pyrazoline;
1-phenyl-3-(p-diethylaminostyryl)-4-methyl-5-(p-diethylaminophenyl)pyrazoline; and
spiropyrazoline;

oxazole compounds such as:

2-(p-diethylaminostyryl)-3-diethylaminobenzoxazole; and
2-(p-diethylaminophenyl)-4-(p-Dimethylaminophenyl)-5-(2-chlorophenyl)oxazole; dimethylaminophenyl)-5-(2-chlorophenyl)oxazole; thiazole compounds such as:

2-(p-diethylaminostyryl)-6-diethylaminobenzothiazole;

triarylmethane compounds such as:

bis(4-diethylamino-2-methylphenyl)phenylmethane;

polyarylalkanes such as:

1,1-bis(4-N,N-diethylamino-2-methylphenyl)heptane;

1,1,2,2-tetrakis(4-N,N-dimethylamino-2-methylphenyl) ethane;

benzidine compounds such as:

N,N'-diphenyl-N,N'-bis(methylphenyl)benzidine;

N,N'-diphenyl-N,N'-bis(ethylphenyl)benzidine;

N,N'-diphenyl-N,N'-bis(propylphenyl)benzidine;

N,N'-diphenyl-N,N'-bis(butylphenyl)benzidine;

N,N'-bis(isopropylphenyl)benzidine;

N,N'-diphenyl-N,N'-bis(secondary butylphenyl) benzidine;

N,N'-diphenyl-N,N'-bis(tertiary butylphenyl)benzidine;

N,N'-diphenyl-N,N'-bis(2,4-dimethylphenyl)benzidine; and

N,N'-diphenyl-N,N'-bis(chlorophenyl)benzidine; and triphenylamine;

poly-N-vinylcarbazole;

polyvinyl pyrene;

polyvinyl anthracene;

polyvinyl acridine;

poly-9-vinylphenyl anthracene;

pyrene-formaldehyde resin; and ethylcarbazole formaldehyde resin.

Among them, the benzidine transporting materials and, particularly, the transporting materials represented by the general formula (10),

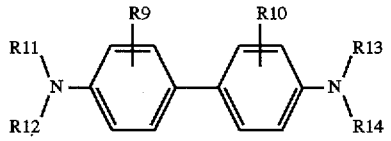

(10)

wherein R9and R10 are lower alkyl groups such as methyl groups or ethyl groups, R11, R12, R13 and R14 are alkyl groups, cycloalkyl groups, aryl groups, alkaryl groups or aralkyl groups with not more than 18 carbon atoms, and the carbazole hydrazone transporting materials and, particularly, those transporting materials represented by the general formula (11)

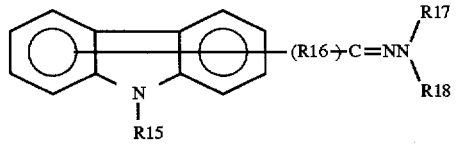

(11)

wherein R15 is a hydrogen atom, alkyl group or acyl group, R16 is a divalent organic group such as alkylene group, and R17 and R18 are each alkyl group, cycloalkyl group, aryl group, alkaryl group or aralkyl group with not more than 18 carbon atoms, are preferred owing to their solubility and positive hole-transporting property.

In the single-dispersion-layer photosensitive material used in the present invention, it is desired that the charge-generating material (CGM) is contained in the photosensitive layer in an amount of from 1 to 7% by weight and, particularly, from 2 to 5% by weight per the solid component and the charge-transporting material (CTM) is contained in the photosensitive layer in an amount of from 20 to 70% by weight and, particularly, from 25 to 60% by weight per the solid component.

From the standpoint of sensitivity and broadening the application such as enabling the reversal development, furthermore, it is desired that the electron-transporting material (ET) and the positive hole-transporting material (HT) are used in combination. In this case, it is most desired that weight ratio of ET:HT is from 10:1 to 1:10 and, particularly, from 1:5 to 1:1.

The composition for forming the photosensitive material used in the present invention may be blended with a variety of blending agents that have been widely known within ranges in which they do not adversely affect the electrophotographic characteristics, such as anti-oxidizing agent, radical trapping agent, singlet quencher, UV-absorbing agent, softening agent, surface reforming agent, defoaming agent, filler, viscosity-imparting agent, dispersion stabilizer, wax, acceptor, donor and the like.

When a steric hindrance phenolic anti-oxidizing agent is blended in an amount of from 0.1 to 50% by weight per the whole solid component, furthermore, it is allowed to drastically improve the durability of the photosensitive layer without adversely affecting the electrophotographic properties.

As the electrically conducting substrate for providing a single-layer organic photosensitive layer, there can be used a variety of materials having electrically conducting property such as single metals like aluminum, copper, tin, platinum, gold, silver, vanadium, molybdenum, chromium, cadmium, titanium,. nickel, indium, stainless steel, brass, plastic materials on which the above-mentioned metals are vaporized or laminated, and glasses coated with aluminum iodide, tin oxide or indium oxide.

The shape of the photosensitive material that is used is not limited to only those of the drum type but may be those of the type of belt or sheet.

In the single-dispersion-layer photosensitive material of the present invention, it may be employed an aluminum blank tube, preferably an alumite-treated tube having 1 to 50 μm in thickness of alumite layer on the surface, since there does not develop any interference fringe.

The single-dispersion-layer photosensitive material is obtained by blending the charge-generating material, charge-transporting material and binder resin according to a customary method using, for example, roll mill, ball mill, attritor, paint shaker or an ultrasonic dispersing device, and applying them relying upon a customary application means, followed by drying.

Though there is no particular limitation, the photosensitive layer has a thickness of usually from 10 to 40 μm and, particularly, from 20 to 35 μm.

A variety of organic solvents can be used for obtaining a coating solution. Examples include alcohols such as methanol, ethanol, isopropanol, butanol, etc., aliphatic hydrocarbons such as n-hexane, octane, cyclohexane, etc., aromatic hydrocarbons such as benzene, toluene, xylene, etc., halogenated hydrocarbons such as dichloromethane, dichloroethane, carbon tetrachloride, chlorobenzene, etc., ethers such as dimethyl ether, diethyl ether, tetrahydrofurane, ethylene glycol dimethyl ether, diethylene glycol dimethyl ether, etc., ketones such as acetone, methyl ethyl ketone, cyclohexanone, etc., esters such as ethyl acetate, methyl acetate, etc., as well as dimethyl formamide, dimethyl sulfoxide, etc., which may be used in one kind or being mixed in two or more kinds. The coating solution should contain a solid component at a concentration of, usually, from 5 to 50%.

[Electrophotographic Process]

The photosensitive material may be mainly charged by corona charging using Corotron, Scorotron or the like, or by a widely known contact-type charging device using a charging brush, charging roll or charging blade. In general, it is desired that the main charging is effected such that the saturation charging potential (VS) is from 400 to 1500 V and, particularly, from 600 to 1200 V. In the case of the corona charging, therefore, it is desired that a voltage of from 4 to 10 KV is applied to the charger. In the contact-type charging, on the other hand, it is desired that a voltage which is from 3 to 6 times as great as the charge starting voltage of the photosensitive material is applied to the charging device.

In the present invention, the photosensitive material after it is mainly charged is exposed to image-bearing light to form an electrostatic latent image. The source of light for exposure to light may be any source of visible light such as halogen lamp, fluorescent lamp, cold cathode tube, or red or green neon lamp. It is, however, also allowable to use a source of hypochromic light such as red, yellow or green LED. It is further allowed to use a source of laser beam such as semiconductor laser beam.

In this case, the amount of exposure to light (IB) at a bright portion is such that the residual potential (ER) at the bright portion is lower than the bias potential (EB) and is, more preferably, such that the residual potential (ER) at the bright portion lies within a range defined by the formula (7).

The developing is effected by applying a developing bias potential (EB) and, preferably, by applying a potential that satisfies the formula (2) to across the photosensitive material and the developing sleeve, the developing bias potential (EB) having the same polarity as the potential of the photosensitive material and being higher than a potential that corresponds to the point of intersection H (FIG. 2) of a line F approximating the zone of a large amount of exposure to light and a line G approximating the zone of a small amount of exposure to light in the light decay characteristics curve of the photosensitive material.

It is desired that the developing is effected by the magnetic brush developing. For this purpose, a one-component or a two-component magnetic developer is used. This is because, in the present invention, the developing is effected in a state of a potential contrast which is rather lower than that of the conventional method. In this respect, magnetic properties of the toner seriously affect the setting of threshold developing value without fogging.

The one-component magnetic developer used in the present invention contains a magnetic powder in the toner, and the two-component magnetic developer comprises a mixture of a toner and a magnetic carrier.

To obtain a high density image by developing in a state of low potential contrast without generating fogging, it is desired that the amount of electric charge possessed by the toner is maintained at a relatively low level. In general, it is desired that the amount of electric charge of the toner is maintained within a range of from 10 to 30 μC/g and, particularly, from 15 to 25 μC/g.

As the binder resin which is a toner component, there can be used a thermoplastic resin, an uncured thermosetting resin, or a thermosetting resin of an initial condensation product. Suitable examples include, in order of suitability, vinyl aromatic resin such as polystyrene, styrene-acrylic copolymer resin, acrylic resin, polyvinyl acetal resin, polyester resin, epoxy resin, phenol resin, petroleum resin, olefin resin and the like.

To adjust the toner charge to lie within the above-mentioned range, there are used, as required, a charge control agent like an oil-soluble dye such as Nigrosine base (CI 50415), oil black (CI 26150), spiron black or the like, or metal complex dye, metal salt of naphthenic acid, metal soap of fatty acid, and salt of resin acid.

It is further allowable to impart a minimum degree of charge control action necessary for the developing by utilizing the charge control action possessed by the resin. That is, there can be used a copolymerized resin or a resin composition having anionic or cationic polar group as part of the fixing resin medium in the toner that is used. As the cationic polar groups, there can be exemplified basic nitrogen-containing groups such as primary, secondary or tertiary amino group, quaternary ammonium group, amide group, imino group, imido group, hydrazino group, guanidino group and amidino group. As the anionic groups, there can be exemplified carboxyl group, sulfone group, phosphone group, etc. As the above-mentioned resins, furthermore, there can be exemplified resins obtained by polymerizing a cationic or anionic polar group-containing monomer with other monomers or resins by such means as random copolymerization, block copolymerization or graft copolymerization.

As the coloring agent to be contained in the resin, there can be used the following inorganic or organic pigments and dyes in a single kind or in a combination of two or more kinds, though there is no particular limitation: carbon black such as furnace black or channel black; iron black such as tri-iron tetroxide; rutile or anatase type titanium dioxide; Phthalocyanine Blue; Phthalocyanine Green, cadmium yellow, molybdenum orange; Pyrazolone Red; Fast Violet B; and the like.

The above-mentioned coloring agent is used in an amount of from 5 to 20 parts by weight and, particularly, 10 to 15 parts by weight per 100 parts by weight of a fixing resin medium.

The above-mentioned resin may contain, as a release agent for thermal fixing, a variety of waxes and low molecular olefin resins. Here, the olefin resins may have a number average molecular weight (Mn) of from 1000 to 10000 and, particularly, from 2000 to 6000. As the olefin resin, there can be used polypropylene, polyethylene or propylene-ethylene copolymer. Among them, polypropylene is particularly preferred.

As the magnetic materials to be added to the toner or to be used as a magnetic carrier, there can be used widely known magnetic materials such as tri-iron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper ) oxide ($CuFe_2O_4$), lead iron oxide ($PbFe_{12}O_{19}$), nickel iron oxide ($NiFe_2O_4$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni) and the like. It is desired that these magnetic materials generally have saturation magnetization of from 30 to 70 emu/g.

In the case of the one-component toner, it is desired that the magnetic fine powder is contained in an amount of from 20 to 50% by weight relative to the toner.

As the magnetic carrier, on the other hand, there can be used tri-iron tetroxide, ferrite or iron powder that has been widely known. The magnetic carrier of the ferrite type is particularly suited. It is desired that the magnetic carrier has an average particle diameter of from 60 to 150 μm, and the magnetic carrier having a particle diameter of not larger than 44 μm occupies 3 to 15% by weight. The magnetic carrier, usually, has a density ρc of from 3.50 to 6.50 g/cm$^3$ and, particularly, from 4.00 to 5.50 g/cm$^3$ though it may vary depending upon the carrier concentration C/D.

It is desired that the saturation magnetization of the carrier is from 30 to 70 emu/g and, particularly, from 53 to 65 emu/g. The magnetic carrier is desirably a ferrite carrier and, particularly, a spherical ferrite carrier satisfying the above-mentioned conditions. The particle size distribution satisfies the above-mentioned conditions but should desirably have a normal distribution or a distribution close thereto. The carrier that is used may not be coated or may be coated with a widely known resin such as silicone resin, acrylic resin, epoxy resin or fluorine-containing resin.

The electric resistance of the ferrite carrier varies depending upon its chemical composition but also varies depending upon its particle structure, production method, kind of coating and the thickness. In general, the volume resistivity should be from $5\times10^8$ to $5\times10^{11}$ Ω·cm and, particularly, from $1\times10^9$ to $1\times10^{11}$ Ω·cm.

It is desired that the weight percentage of the toner T/D in the developer is, usually, from 3 to 8% and, particularly, from 3.5 to 7.5%. It is further desired that the developer as a whole has an electric resistance of from $1\times10^9$ to $1\times10^{11}$ Ω·cm and, particularly, from $5\times10^9$ to $5\times10^{11}$ Ω·cm.

It is better to use toner particles having an average particle diameter of from 5 to 15 μm and, particularly, from 8 to 12 μm. The particles may have an irregular shape as prepared by the melt-kneading method or pulverization method, or may have a spherical shape as prepared by the dispersion or suspension polymerization method.

The toner can be produced by any known method such as pulverization-classification method, melt-granulation method, spray-granulation method or polymerization method. The pulverization-classification method, however, is generally employed.

The toner components are mixed in advance by a mixer such as Henschel's mixer and are kneaded by using a kneader such as a biaxial extruder. The kneaded composition is then cooled, pulverized and is classified to obtain a toner.

As an agent to be externally added to the toner, furthermore, use is made of magnetic fine particles and hydrophobic silica in combination from the standpoint of preventing fogging on the white paper exposed to light and improving image density.

As the magnetic fine particles, use is made of the above-mentioned magnetic fine particles having a particle diameter of from 0.1 to 0.5 μm. The magnetic powder which is particularly adapted to this purpose is a fine particulate tri-iron tetroxide (magnetite). The preferred magnetite has an ortho-octahedral shape. The magnetite particles may be treated for their surfaces with a silane coupling agent or a titanium coupling agent. The magnetite particles of which the surfaces are treated with the titanium coupling agent are desirable from the standpoint of resistance against environment.

The hydrophobic silica that is externally added is obtained by treating vapor-phase silica, i.e., by treating fine silica obtained by subjecting silicon chloride to a high-temperature (flame) hydrolysis with an organic silicon compound such as silanes like dimethyl dichlorosilane, trimethyl chlorosilane or the like, and by blocking silanol on the surface with organosilane.

To peel thin deteriorated layer on the surface of the photosensitive material, furthermore, a toner to which an abrasive or a polishing material is externally added can be used for the developer of any type.

Any known abrasive or polishing material can be used having an average particle diameter of from 0.1 to 5 μm and, particularly, from 0.15 to 1 μm. It is desired that these abrasive or polishing material usually has a Mohs'hardness of from 5 to 10.

Though there is no particular limitation, preferred examples of the abrasive or the polishing material include oxide ceramics such as alumina ($Al_2O_3$), zirconia ($ZrO_2$), mullite ($3Al_2O_3{\cdot}2SiO_2$), cordierite ($2MgO/2Al_2O_3/5SiO_2$), titania ($TiO_2$), steatite ($MgO_2{\cdot}SiO_2$), silica, and silica alumina; carbide ceramics such as silicon carbide ($SiO_2$), tungsten carbide (WC), and zirconium carbide (ZrC); nitride ceramics such as boron nitride (BN), titanium nitride (TiN), and silicon nitride ($Si_3B_4$); boride ceramics such as zirconium boride ($ZrB_2$) and titanium boride ($TiB_2$); silicate ceramics such as tungsten silicate ($WSi_2$) and molybdenum silicate ($MoSi_2$); as well as diamond, corundum, chromium oxide, cerium oxide, and the like.

The amount of the abrasive or the polishing material added to the toner varies depending upon the kind of the abrasive or the polishing material and cannot be definitely determined. Generally, however, the amount of addition may be selected over a range of from 0.1 to 10% by weight and, particularly, from 0.5 to 5% by weight with respect to the toner, so that optimum scraping amount is obtained. That is, relationships are found between the amount of the toner added and the scraping amount for the abrasives or the polishing materials as shown in FIG. 3, and the amount of blending the abrasive or the polishing material may be so determined that an optimum scraping amount (oxidation degree on the surface of the photosensitive material) is obtained.

In the electrophotographic method of the present invention, the toner image is transferred, the paper is separated and the cleaning is effected by using known means under known conditions.

EXAMPLES

The present invention will be described by way of the following Examples.

The photosensitive material used in Examples was prepared as described below.

Preparation of the Single-Laver Photosensitive Material (Photosensitive Material α) for Electrophotography:

The following composition for a single-layer organic photosensitive layer was mixed and dispersed in a ball mill for 50 hours to prepare a coating solution for forming a single-layer photosensitive layer. The obtained coating solution was immersion-applied to the surface of an aluminum cylinder having an outer diameter of 78 mm which is an electrically conducting base material, and was dried with the hot air heated at 100° C. for 60 minutes to form a single-layer photosensitive material having a thickness of 25 μm to obtain a positively charged photosensitive material for electrophotography.

| | |
|---|---|
| Bisazo dye (following formula 12) | 10 parts by weight |
| N,N,N',N'-tetrakis (3-methyl-phenyl)-m-phenylene diamine | 100 parts by weight |
| 3,5,3',5'-tetraphenyl-diphenoquinone | 50 parts by weight |
| Polycarbonate resin | 100 parts by weight |
| Dichloromethane | 800 parts by weight |

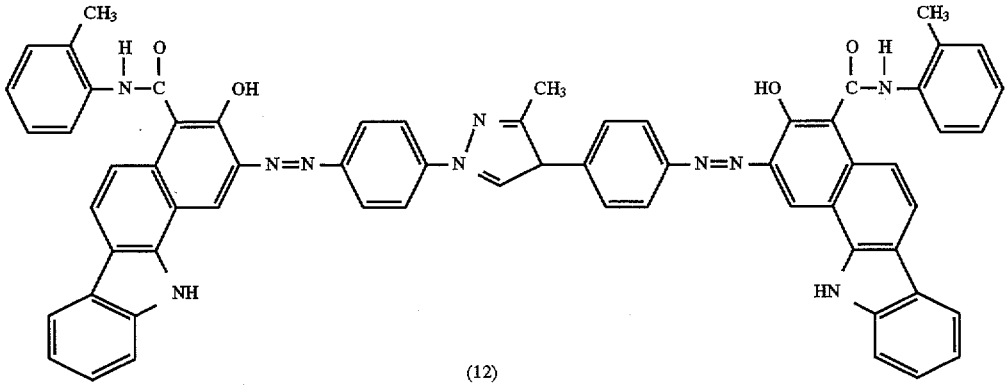

(12)

Preparation of a Laminated-Laver Photosensitive Material (Photosensitive Material β) for Electrophotography:

(1) Preparation of a charge-generating layer

The following composition for a single-layer organic photosensitive layer was mixed and dispersed in a ball mill for 50 hours to prepare a coating solution for generating electric charge. The obtained coating solution was immersion-applied to the surface of an aluminum cylinder having an outer diameter of 78 mm which is an electrically conducting base material, and was dried with the hot air heated at 100° C. for 60 minutes to form a charge-generating layer having a thickness of 0.5 μm.

| | |
|---|---|
| Bisazo dye (above-mentioned formula 12) | 2 parts by weight |
| Polyvinyl butyral resin | 1 part by weight |
| Dichloromethane | 120 parts by weight |

(2) Preparation of a charge-transporting layer

The following composition for a photosensitive layer was mixed and dispersed in a ball mill for 24 hours to prepare a coating solution for transporting electric charge. The obtained coating solution was immersion-applied onto the above-mentioned charge-generating layer and was dried with the hot air heated at 90° C. for 60 minutes to form a charge-transporting layer having a thickness of 15 μm in order to form a laminated-layer photosensitive material.

| | |
|---|---|
| N,N,N',N'-tetrakis(3-methyl-phenyl)-m-phenylene diamine | 80 parts by weight |
| Polycarbonate resin | 100 parts by weight |
| Dichloromethane | 800 parts by weight |

The developer used in the experiments was prepared as described below.

Negatively charged toner I.

| | |
|---|---|
| Styrene-acrylic polymer | 100 parts by weight |
| Carbon black | 6 parts by weight |
| Chromium complex dye (charge control material) | 1 part by weight |

-continued

| | |
|---|---|
| Low molecular polypropylene (release agent) | 2 parts by weight |

The above-mentioned components were melt-kneaded in a biaxial extruder, pulverized in a jet mill, and were subjected to the pneumatic classification using a classifier to obtain toner particles having an average particle diameter of 11 μm.

The above toner particles and the hydrophobic silica fine particles (R972 produced by Japan Aerosil Co.) were mixed and dispersed at a ratio of 0.3% by weight with respect to the total amount of the toner to obtain a negatively charged toner I.

Negatively charged toner II.

| | |
|---|---|
| Styrene-acrylic polymer | 100 parts by weight |
| Carbon black | 6 parts by weight |
| Chromium complex dye (charge control agent) | 1 part by weight |
| Low molecular polypropylene (release agent) | 2 parts by weight |

The above-mentioned components were melt-kneaded in a biaxial extruder, pulverized in a jet mill, and were subjected to the pneumatic classification using a classifier to obtain toner particles having an average particle diameter of 8 μm.

The above toner particles and the hydrophobic silica fine particles (R972 produced by Japan Aerosil Co.) were mixed and dispersed at a ratio of 0.5% by weight with respect to the total amount of the toner to obtain a negatively charged toner II.

Positively charged toner III [for OPC]

| | |
|---|---|
| Styrene-acrylic polymer | 100 parts by weight |
| Carbon black | 9 parts by weight |
| Nigrosine dye (charge control agent) | 1 part by weight |
| Low molecular polypropylene (release agent) | 2 parts by weight |

The above-mentioned components were treat in the same manner as the negatively charged toner I to obtain toner particles having an average particle diameter of 10 μm.

The above toner particles and the hydrophobic silica fine particles (RA130H produced by Japan Aerosil Co.) were mixed and dispersed at a ratio of 0.3% by weight with respect to the total amount of the toner to obtain a positively charged toner C having an average particle diameter of 10 μm.

Negatively charged toner IV [for a-Si]

| | |
|---|---|
| Styrene-acrylic polymer | 100 parts by weight |
| Carbon black | 6 parts by weight |
| Chromium complex dye (charge control agent) | 1 part by weight |
| Low molecular polypropylene (release agent) | 2 parts by weight |

The above-mentioned components were melt-kneaded in a biaxial extruder, pulverized in a jet mill, and were subjected to the pneumatic classification using a classifier to obtain toner particles having an average particle diameter of 10 μm.

To the above toner particles were mixed and dispersed hydrophobic silica fine particles (R972 produced by Japan Aerosil Co.) at a ratio of 0.3% by weight and aluminum oxide (Aluminum Oxide C produced by Japan Aerosil Co.) at a ratio of 0.2% by weight with respect to the total amount of the toner to obtain a negatively charged toner (IV). developer for +OPC (positively charged organic photosensitive material) and for a-Si photosensitive material.

The negatively charged toners I, IV were blended with a ferrite carrier having an average particle diameter of 100 μm of which the surfaces were coated with an acrylic resin and a melamine resin, and the negatively charged toner II was blended with a ferrite carrier having an average particle diameter of 80 μm with stirring to homogeneously mix them together in order to obtain a two-component developer having a toner concentration of 3.5%. developer for -OPC.

The positively charged toner III was blended with a ferrite carrier having an average particle size of 80 μm of which the surfaces were coated with an acrylic resin and a melamine resin with stirring to homogeneously mix them together in order to prepare a two-component developer having a toner concentration of 40%.

An amorphous silicon (a-Si) photosensitive material (photosensitive material γ) was also used in addition to the photosensitive material α (single-layer organic photosensitive material) and photosensitive material β (laminated-layer organic photosensitive material). That is, the photosensitive material having the same-specifications as the a-Si photosensitive material mounted on the electrophotographic copying machine DC-6090 produced by Mita Kogyo Co. was prepared in such a size that can be mounted on a machine modified from the electrophotographic copying machine DC-4556 produced by Mita Kogyo Co.

Characteristics of the photosensitive material were found as described below.

[Measurement of light decay characteristics]

The above-mentioned photosensitive materials α, β and γ were mounted on the machine modified from the electrophotographic copying machine DC-4556 produced by Mita Kogyo Co. shown in FIGS. 5 and 6, the surface potential at the developing positions was set to be 800 V, and the surface potential was measured while changing the amount of irradiation light.

The negatively charged laminated-layer organic photosensitive materials were measured by changing the main charging, developing bias, transfer and power transformer of separator shift bias into those of the negative polarity.

The results of measurement were as shown in Table 2. The potentials are in absolute values Vo.

Table 1 shows the values A to D found in compliance with the aforementioned formula (1) for the photosensitive materials α, β and γ, as well as point-of-intersection voltages (EH) found from FIG. 3.

TABLE 1

| Photosensitive material | (α) | (β) | (γ) |
|---|---|---|---|
| Value A | 0.8 | 0.9 | 0.9 |
| Value B | 0.58 | 0.63 | 1.2 |
| Value C | 0.2 | 0.1 | 0.1 |
| Value D | 0.02 | 0.04 | 0.11 |
| EH | 152 | 49.5 | 63.5 |

[Forming the image]

The above-mentioned photosensitive materials α, β and γ were mounted on the machine modified from the electrophotographic copying machine DC-4556 produced by Mita Kogyo Co. shown in FIGS. 5 and 6. By using combinations of photosensitive material α-toner (I), photosensitive material α-toner (II), photosensitive material β-toner (III)and photosensitive material γ-toner (IV) as developers, images were formed while changing the developing bias potential in order to confirm developing characteristics.

By using the Munsell grey scale (manufactured by Nippon Shikiken Co.), the amount of exposure to light was so adjusted that a difference in the image density between N8.0 and N9.5 was 0.005 as measured by a reflection densitometer. ID represents image density (image density with respect to N1.5) and FD represents image fogging (difference between the density of N9.0 and density of non-transferred paper). The results were as shown in Table 2.

[Bias developing]

By using the machine modified from the electrophotographic copying machine DC-4556 produced by Mita Kogyo Co., bias potentials (fogging-preventing potentials) were found with which the fogging found from the bias developing characteristics shown in FIG. 4 became FD=0.000 for the combinations of the photosensitive materials and the developers.

Experiment was conducted without applying voltage to the main charger (MC) and changing the voltage applied to the developing sleeve by using an external power source (Model 1041 manufactured by Kikusui Co.) in order to find image density relative to the voltage applied to the developing bias. The results were as shown in Table 2.

According to the results of Table 2, in the single-layer organic photosensitive material, it is obvious that the fogging density increases and the amount of exposure to light increases when the developing bias potential (EB) is smaller than the point-of-intersection potential (EH). When the developing bias potential (EB) is set to be at least 1.5 times higher than the point-of-intersection potential (EH), however, the fogging density decreases yet maintaining a high image density, and the amount of exposure to light can be decreased.

But, in the laminated organic photosensitive material or the amorphous silicon photosensitive material, when the developing bias potential (EB) is set to be about 1.5 times higher than the point-of-intersection potential (EH), the fogging density is yet in high label, so the point-of-intersection voltage (EH) is meaningless for setting the developing bias voltage According to the present invention, a bias potential (absolute value) applied during the developing is set to be higher than a potential (absolute value) that corresponds to an intersecting point of a line approximating to a light decay curve of a single-layer organic sensitive material in the zone of a large amount of exposure to light and a line approximating to said curve in the zone of a small amount of exposure to light, in order to entirely utilize the high-sensitivity characteristics in the zone of a small amount of exposure to light and, hence, to form image of a high density without fogging but sacrificing low-sensitivity characteristics in the zone of a large amount of exposure to light to a small degree, i.e., sacrificing a potential drop to a small degree.

Moreover, since the bias potential is set to a relatively large value, the amount of exposure to light needs be small and, hence, the source of light needs have a small output, requiring a cooling fan of a small size for removing the heat from the source of light. This makes it possible to decrease the cost of the apparatus and the power cost. Moreover, since the organic photosensitive material needs be irradiated with a small amount of light, the photosensitive material is less deteriorated with light, which is an advantage. Furthermore, the step of exposure to light is accomplished within short periods of time, making it possible to greatly increase the copying speed, printing speed of a facsimile and printing speed of a laser printer.

TABLE 2

Developing bias potential and developing fogging

| | Drum | Toner | Fogging-preventing potential | Developing bias potential | ID | FD | Amount of exposure to light |
|---|---|---|---|---|---|---|---|
| Example 1 | photosensitive material α | toner I | 80 | 250 | 1.48 | 0.002 | 7.0 |
| Example 2 | photosensitive material α | toner I | 80 | 280 | 1.43 | 0.001 | 4.8 |
| Example 3 | photosensitive material α | toner I | 80 | 310 | 1.42 | 0.001 | 3.0 |
| Comparative Example 1 | photosensitive material α | toner I | 80 | 150 | 1.48 | 0.012 | 10.0 |
| Example 4 | photosensitive material α | toner II | 60 | 250 | 1.45 | 0.001 | 4.0 |
| Example 5 | photosensitive material α | toner II | 60 | 300 | 1.42 | 0.001 | 2.7 |
| Comparative Example 2 | photosensitive material β | toner III | 60 | 120 | 1.46 | 0.010 | 7.0 |
| Comparative Example 3 | photosensitive material γ | toner IV | 60 | 100 | 1.46 | 0.010 | 6.0 |

We claim:

1. An electrophotographic method comprising electrically charging a single-layer organic photosensitive material, exposing the photosensitive material to image-bearing light to form electrostatic latent image, and developing the electrostatic latent image in a state where a developing bias voltage is applied, wherein said developing bias voltage is set to a potential which has a polarity same as the polarity of the electric charge in the photosensitive material, and is higher than a potential (EH) that corresponds to a point where a straight line approximating to a light decay characteristics curve in the zone of a large amount of exposure to light and a straight line approximating to said curve in the zone of a small amount of exposure to light intersect each other.

2. An electrophotographic method according to claim 1, wherein the photosensitive material is a single-dispersion-layer photosensitive material obtained by dispersing a charge-generating substance in a resin medium that contains a charge-transporting substance.

3. An electrophotographic method according to claim 1, wherein the photosensitive material is a single-layer organic photosensitive material having light decay characteristics represented by the following formula (1), $$V=Vo\{A\cdot\exp(-B\cdot I)+C\cdot\exp(-D\cdot I)\} \quad (1)$$

where I is an amount of exposure to light (lux·sec), V is an absolute value (volts) of potential on the surface of the photosensitive material when the amount of exposure to light is I, Vo is an absolute value (volts) of initial potential on the surface of the photosensitive material, A and C are numerals of from 0.7 to 1 (exclusive) and from 0 (exclusive) to 0.3, respectively, under the condition that their sum is 1, B is a coefficient of from 0.1 to 1.5 $lux^{-1}\cdot sec^{-1}$, and D is a coefficient of from 0.01 to 0.2 $lux^{-1}\cdot sec^{-1}$.

4. An electrophotographic method according to claim 3, wherein the developing bias voltage (EB) is set to satisfy the following formula (2), $$EB=m[Y\times10^{Z}]$$

wherein

Y is an antilogarithm of a martissa of formula of $$\frac{P\times L-K\times Q}{P-K} \quad (2a)$$

Z is an index of formula of $$\frac{P\times L-K\times Q}{P-K} \quad (2a)$$

where, $$K=\frac{\log VL_{0.9}-\log VL_{0.7}}{IL_{0.9}-IL_{0.7}} \quad (3)$$

$$P=\frac{\log VS_{0.9}-\log VS_{0.8}}{IS_{0.9}-IS_{0.8}} \quad (4)$$

$$L=\frac{\log VL_{0.9}IL_{0.7}-\log VL_{0.7}IL_{0.9}}{IL_{0.7}-IL_{0.9}} \quad (5)$$

-continued $$Q=\frac{\log VS_{0.9}IS_{0.8}-\log VS_{0.8}IS_{0.9}}{IS_{0.8}-IS_{0.9}} \quad (6)$$

where $VL_{0.9}$ is 0.9 VoA, $IL_{0.9}$ is the amount of exposure to light corresponding to $VL_{0.9}$ of the formula (1), $VL_{0.7}$ is 0.7V0A, $IL_{0.9}$ is the amount of exposure to light corresponding to $VL_{0.7}$ of the formula (1), $VS_{0.9}$ is 0.9 VoC, $IS_{0.9}$ is the amount of exposure to light corresponding to $VS_{0.9}$ of the formula (1), $VS_{0.8}$ is 0.8 VoC, $IS_{0.8}$ is the amount of exposure to light corresponding to $VS_{0.8}$ in the formula (1), and m is a number not smaller than 1.5.

5. An electrophotographic method according to claim 4, wherein in the above-mentioned formula (2) representing the bias potential (EB), the value of m is set to be from 1.5 to 4.0.

6. An electrophotographic method according to any one of claims 1 to 5, wherein in exposing the image to light, the amount of exposure to light at a bright portion is so set that the absolute value of a residual potential (ER) at the bright portion is smaller than the absolute value of the bias potential (EB).

7. An electrophotographic method according to claim 6, wherein in exposing the image to light, the amount of exposure to light in a bright portion is so set that the residual potential (ER) in the bright portion satisfies the formula (7), $$ER=EB-nED0 \quad (7)$$

where EB is a developing bias potential, ED0 is a potential at which the fogging density becomes substantially zero in relation to developing sensitivity characteristics of a combination of the photosensitive material and the developer, and n is a number of from 0.4 to 2.5.

8. An electrophotographic method according to claim 7, wherein the amount of exposure to light at a bright portion is so set that the value n in the formula (7) becomes from 0.5 to 1.0.

* * * * *